United States Patent [19]

Agadi

[11] Patent Number: 4,515,138

[45] Date of Patent: May 7, 1985

[54] INTERNAL COMBUSTION ENGINES

[76] Inventor: Isaac Agadi, 16 Ir Hayona St., Tel-Aviv, Israel

[21] Appl. No.: 50,017

[22] Filed: Jun. 19, 1979

[30] Foreign Application Priority Data

Jun. 23, 1978 [IL] Israel ..... 54993

[51] Int. Cl.[3] ..... F02M 29/00

[52] U.S. Cl. ..... 123/590; 48/180 R

[58] Field of Search ..... 123/119 E, 141, 590; 48/180 R

[56] References Cited

U.S. PATENT DOCUMENTS

| | | | |
|---|---|---|---|
| 1,396,054 | 11/1921 | Potter | 48/180 R |
| 2,017,043 | 10/1935 | Galliot | 123/141 |
| 2,384,681 | 9/1945 | Janes | 123/141 |
| 2,498,190 | 2/1950 | Weeks | 48/180 R |
| 2,685,504 | 8/1954 | Ulbing | 48/180 R |
| 3,717,129 | 2/1973 | Fox | 123/119 E |
| 3,735,744 | 5/1973 | Brody | 123/590 |
| 3,749,545 | 7/1973 | Velkoff | 123/119 E |
| 3,938,967 | 2/1976 | Reissmuller | 123/590 |
| 4,023,544 | 5/1977 | Cole | 123/119 E |
| 4,088,104 | 5/1978 | Ibbott | 123/590 |
| 4,092,966 | 6/1978 | Prosen | 123/590 |

FOREIGN PATENT DOCUMENTS

| | | | |
|---|---|---|---|
| 967836 | 5/1975 | Canada | 123/141 |
| 820820 | 7/1949 | Fed. Rep. of Germany | 48/180 |
| 176437 | 6/1935 | Switzerland | 123/141 |

*Primary Examiner*—Ronald H. Lazarus

*Attorney, Agent, or Firm*—Ladas & Parry

[57] ABSTRACT

The present invention relates to a device for use in conjunction with internal combustion engines, to be located between the carburetor and between the manifold of the engine, comprising a cylindrical member wherein there is provided a plurality of vanes starting at an angle of about zero degrees at the inlet and which are bent to an angle of about 90° at the outlet, said vanes meeting near the outlet at the axis of the cylinder, which is optionally provided with means for applying a high voltage (about 2000 V to 10,000 V) to the droplets of the fuel mixture. Similar devices can be used for improving the power output of burners and the like.

6 Claims, 3 Drawing Figures

INTERNAL COMBUSTION ENGINES

FIELD OF THE INVENTION

The invention relates to a device for use in conjunction with internal combustion engines, and especially for use with internal combustion engines of the type used in motor cars, which device is intended to bring about a better utilization of the fuel, thus reducing fuel consumption and decreasing pollution resulting from the effluents of such motor cars.

The device according to the invention can also be used with various types of stationary internal combustion engines, with burners which use fuels of the same or similar type as motor-vehicles and the like. It is to be clear that although the invention is illustrated with reference to internal combustion engines of motor-vehicles, this is to be construed in a non-limitative manner.

BACKGROUND OF THE INVENTION

With the increase of the cost of fuel and especially of high-grade gasoline used in motor-cars, and also with an increase in the awareness of the problems of pollution, various attempts have been made to reduce fuel consumption and to decrease the content of pollutants in the exhaust gases of motor-cars. Attempts have been made to bring about a better mixing of the air-gasoline mixture obtained in the carburettor, and this in order to obtain a more homogeneous mixture.

The devices suggested hitherto have not attained the intended results and have not found any practical application. The above also applies to the application of sonic energy to the fuel-air mixture.

STATE OF THE PRIOR ART

Various devices have been suggested for improving the mixing of the fuel-air mixture.

Such devices are described in U.S. Pat.: No. 1,937,875—Denman et al, issued Dec. 5, 1933; No. 3,077,391—Guffra, issued Feb. 12, 1963, No. 3,530,844—Kawai—issued Sept. 29, 1970, No. 3,735,744, Brody et al., issued May 29, 1973, No. 3,952,716, Reissmueller, issued Feb. 17, 1976, No. 3,952,716, McCauley, issued Apr. 27, 1976, No. 3,955,548, Thomas, issued May 11, 1976, No. 4,015,574, Hanff, issued Apr. 5, 1977.

It is a drawback of most of these patents that the suggested structures present a rather high resistance to the flow of the gaseous fuel mixture. This drawback is overcome by the present invention which results in a very appreciable saving of fuel.

SUMMARY OF THE INVENTION

The present invention relates to a novel device for use with internal combustion engines, and especially of engines of motor-cars. The novel device results in a substantial decrease of fuel consumption and also in a better utilization of the fuel, resulting in substantially cleaner exhaust gases.

The novel device is inserted between the carburettor and between the manifold, and it comprises a cylindrical member, in which there is provided a plurality of vanes which impart the combustion mixture a gyratory movement in a controlled manner, said vanes starting at an angle of about zero degrees at the inlet and of about 90° at the outlet into the manifold of the engine. According to one embodiment the vane structure can be produced by cutting a metal cylinder into a plurality of strips, which adhere at their upper end to the rim of the cylinder, so as to obtain, for example 6 rectangular elongates strips, which are bent in such a manner in the same direction, that their lower left-hand or right-hand corners meet at the axis of the cylinder. In this manner there is obtained a structure which is "closed" when one looks down along the axis of the cylinder, but which presents a very low resistance to the flow of the fuel-air mixture.

The gradual increase of the angle of the vanes, over a predetermined length of the device (ratio of diameter to length) results in an intimate mixture of the combustion mixture, giving a finer dispersion of the fuel droplets in the carrier gas and results in better combustion. In order to enhance the effect a high voltage is applied and this substantially the overall results. It is believed that the high voltage brings about a breakup of larger droplets and also prevents the approach of droplets amongst themselves and their coalescence. The voltage can be taken from the coil of the motor-car; and it is preferably rectified so as to obtain a direct current of high voltage. Experiments have shown that with conventional motor-car engines a reduction of fuel consumption of up to about 25–30 percent can be achieved; furthermore the temperature of the running motor-car is reduced and the engine works in a very smooth and regular manner. Examination of the exhaust gases has shown that the fuel is utilized in a nearly complete manner; the content of carbon oxide is decreased to less than half the regular quantity.

BRIEF DESCRIPTION OF THE DRAWINGS

The invention is illustrated with reference to the enclosed schematical drawings, not according to scale, and in which.

DESCRIPTION OF THE PREFERRED EMBODIMENT

Figure 1:
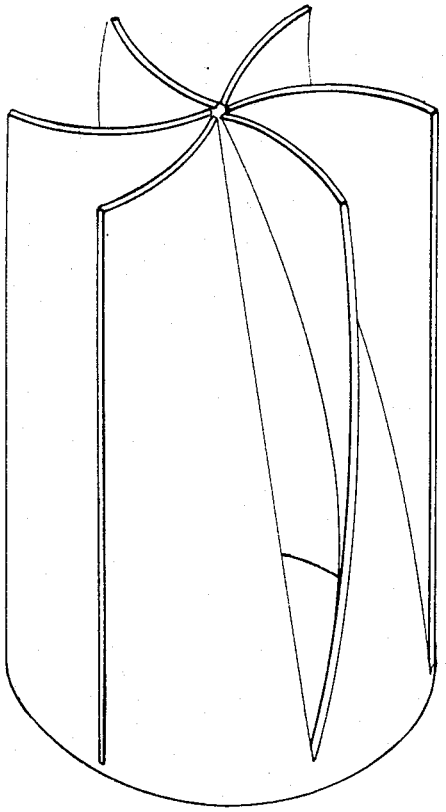
FIG. 1 is a perspective side-view of the vane structure of the device.
Figure 2:
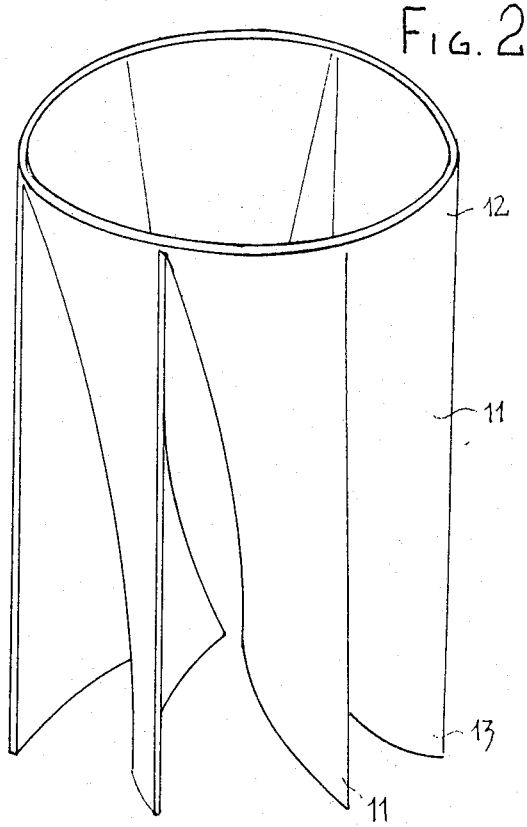
FIG. 2 is another perspective view.
Figure 3:
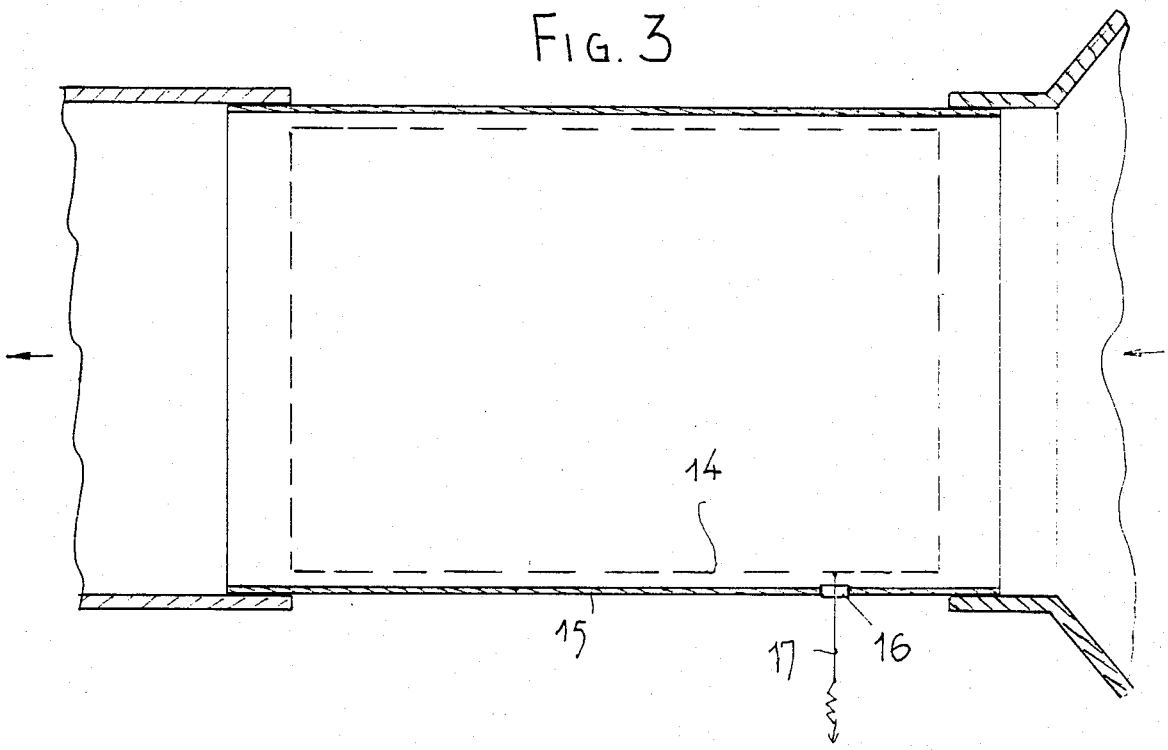
FIG. 3 is an elevational cross-section through a device according to the invention, illustrating the installation in a motor-car engine.

As shown in FIG. 1, the vane-structure of the device, which is inserted in a sleeve of the outer diameter of the structure, comprises a plurality of vanes 11, in the device illustrated six such vanes are provided, which are bent so as to start at the upper end 12 at an angle of nearly zero degrees, and which meet each other at the lower end 13, making an angle of about 90°. As shown in this Figure, the cylinder is cut into six rectangular vanes 11, and these adhere at the upper edge 12 to the rim of the cylinder. The vanes are bent, all in the same direction so that their lower left-hand corners 13' meet at the axis of the cylinder. As shown in FIG. 3, a vane structure of FIG. 2 is enclosed in a cylindrical housing 14 so as to provide a tight fit in said sleeve, which can be made of any suitable material. It is clear that the vane-structure illustrated here is by way of example only, and that various structures may be resorted to without departing from the scope and spirit of the invention. For example, vanes may be supported by a ring-formed structure at about the middle of the height of the cylinder, and be bent so as to form a structure forcing the fuel-air mixture to travel in a circuitous path, similar to the embodiment illustrated above. The cylindrical housing 14 is enclosed in a further cylinder 15 of larger diameter, made of insulating material which extends beyond the housing 14 so as to provide a good electrical insulation. Through an opening 16 in said housing 15 there is inserted a wire 17 which is attached to a suitable source of high voltage, preferably a source of direct current of high voltage. This may be provided from the coil of the motor-car via a suitable rectifier. The wire 17 which is attached to the metallic vane structure provides a source of high potential and this brings about a pronounced improvement of the overall performance of the device. A suitable voltage is of the order of some thousands of volts. Experiments were carried out at voltages between about 5000 V to about 20,000 V. Alternating current from the coil can be rectified by means of a suitable diode. It seems that the high voltage charge brings about a breakup of larger drops and the resulting droplets are charged an identical kind of charge thus replusing each other. The resistance of the entire device to the throughflow of the fuel-mixture is very small. Good results were obtained when the length of the tubular section housing the vane-structure was about twice the diameter of the device. The vane-structure is advantageously made of an electrically conducting material, such as metal; and this may be supported in a cylinder of suitable diameter, made of an insulating material. The cylinder may also be made of a metal and enclosed by a further cylinder of insulating material.

Experiments were carried out with a motor-car engine taken from a Ford Transit Motor-car, type 1600. The following Table summarizes the results obtained during a test run of the engine.

| | Regular Engine | Engine with 6-Vane device, 12000 V |
|---|---|---|
| Oil Pressure | 68 psi | 70 psi |
| Water Temp. °C. | 80 | 68 |
| Revolutions | 2000 | 2000 |
| Vacuum in Carburettor | 8.1 | 9.0 |
| Timing of Engine | Normal | Normal |
| Speed (km/h) | 58 | 60 |
| Load (kg/m) | 6 | 6 |
| CO quantity | 3.8 | 1.5 |
| Km per quantity of gasoline | 85 | 110 |

The above results show that a saving of about 29.4% in fuel consumption was attained.

A further series of tests was carried out on an engine of 1100 ml of a Fiat motor-car. The engine was almost new, it had been run in and tuned according to manufacturers specifications. A Weber type carburetor was used, and the test was carried out on a Froude water brake dynamometer.

Three thermocouples were installed: one in the radiator, one under the spark plug of cylinder No. 3, and one in the exhaust manifold outlet to measure the exhaust gas temperature.

The test was based on the comparison of engine performance with and without the device at steady state points. A total of eight points was tested from 2000 rpm to 3000 rpm. At 3000 rpm four loads were tested, namely $\frac{1}{4}$, $\frac{1}{2}$, $\frac{3}{4}$ and full load. At 2000 rpm $\frac{3}{4}$ load was tested and at 4000 rpm $\frac{1}{2}$ and $\frac{3}{4}$ load. This last point was chosen to test the influence of the device on maximum horsepower.

All parameters were identical during the two test series. The following readings were taken after engine temperature had stabilized: engine rpm, torque, duration of time for the consumation of 60 ml of fuel, CO and HC pollution in percentage and ppm, engine vacuum, pressure drop on the device.

The test showed that the engine equipped with the device according to the invention used at least 10 percent less fuel, and the average of all the tests was near 15 percent saving of fuel. Engine vacuum indicates that the throttle is less open with the device, and this means that less air and less fuel is used per horsepower, indicating a better thermal efficiency. A slight flow restriction due to the device (about 32 to 50 mm Hg) is apparent. Maximum horsepower was not adversely affected, and this indicates that the decrease in flow is cancelled by better thermal efficiency. When leaner fuel mixtures were used, there was a very pronounced decrease of pollution. This was measured with a Peerless 660 infra-red analyzer. The above tests were carried out with the mechanical part of the device only. The addition of the electric part resulted in a slight further improvement of fuel saving.

Trial runs with a motor-car over a few hundreds of kilometers prove that a substantial saving of fuel is attained. This depends on road and traffic conditions, and it is of the order of 10–25% compared with an identical car without the device according to the invention.

Devices according to the present invention can also be used with larger internal combustion engines and also with large burners such as for example burners of the type used in powerplants and the like. The effect of the device is a better utilization of the fuel and a high power output per unit quantity of fuel. According to a preferred embodiment, in larger burners of the type used in powerplants or the like, a certain percentage of water is added to the fuel and this further increases the power output per unit quantity of fuel used.

The above are further aspects of the present invention and it is clear that various changes and modifications of the details described and of the uses may be resorted to without departing from the scope and spirit of the invention.

I claim:

1. A device for improving the combustion characteristics of a flowing fuel-air mixture, the device defining an axis of flow for the mixture and comprising a plurality of vanes extending generally longitudinally of and disposed about said axis, each vane having first and second ends joined by first and second longitudinal edges, the first ends being contiguously arranged to extend along the circumference of a circle coaxial with said axis, said first edges defining a cylindrical surface coaxial with said axis and said second edges defining a conical surface coaxial with said axis, the vanes being interconnected at their first ends and said second ends are disposed generally radially of said axis and extend from said cylindrical surface to said axis, the vanes substantially meeting at said axis.

2. A device according to claim 1 wherein all of the vanes are identical and are symmetrically disposed about said axis with equi-angular spacing.

3. A device according to claim 2 wherein there are six vanes.

4. A device according to claim 3 wherein the area of flow within said device transverse to said flow axis is substantially constant along the longitudinal extension of said device.

5. A device according to claim 4 wherein the planar projection of each vane is a rectangle and each vane is curved transversely of its longitudinal edges with a radius of curvature substantially equal to the radius of said circle.

6. A device for improving the combustion characteristics of a flowing fuel-air mixture, the device defining an axis of flow for the mixture and comprising a plurality of similarly disposed vanes, each vane having first and second ends joined by first and second edges extending ends generally longitudinally of said axis and defining a longitudinal vane axis about which the vane is symmetrically disposed, said first ends being interconnected and contiguously disposed to extend around the flow axis to define the circumference of a circle coaxial with said flow axis, said vane axes passing through said circumference and defining a conical surface about which they extend helically, the conical surface being coaxial with said flow axis and having its major diameter equal to that of said circle, and the first edges defining a cylindrical surface coaxial with said flow axis and of diameter equal to that of said circle, thereby to impart to a flow of fuel-air mixture, passing axially through the device, a helical swirl, planar projection of each vane is a rectangle and each vane is curved transversely of its longitudinal edges with a radius of curvature equal to the radius of said circle, wherein the vanes are symmetrically disposed with each vane twisted about its vane axis by approximately 90° whereby the second ends extend generally radially from said flow axis to said cylindrical surface.

* * * * *